US012698775B2

(12) United States Patent
Al-Otaibi et al.

(10) Patent No.: US 12,698,775 B2
(45) Date of Patent: Aug. 4, 2026

(54) SMOOTH-STARTING ELECTRICAL SUBMERSIBLE PUMPS

(71) Applicant: SAUDI ARABIAN OIL COMPANY, Dhahran (SA)

(72) Inventors: Hazza G. Al-Otaibi, Dhahran (SA); Sultan S. Alotaibi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/757,258

(22) Filed: Jun. 27, 2024

(65) Prior Publication Data

US 2026/0002428 A1 Jan. 1, 2026

(51) Int. Cl.

| | |
|---|---|
| ***F04D 13/08*** | (2006.01) |
| ***E21B 43/12*** | (2006.01) |
| ***F04D 13/02*** | (2006.01) |

(52) U.S. Cl.

CPC ..... *F04D 13/023* (2013.01); *E21B 43/128* (2013.01); *F04D 13/022* (2013.01); *F04D 13/086* (2013.01)

(58) Field of Classification Search

CPC .... F04D 13/022; F04D 13/023; F04D 29/106; F04D 29/126; E21B 43/128

See application file for complete search history.

(56) References Cited

U.S. PATENT DOCUMENTS

| | | | | |
|---|---|---|---|---|
| 2016/0084069 | A1* | 3/2016 | Camacho Cardenas | F04D 29/445 415/118 |
| 2016/0333677 | A1* | 11/2016 | Westberg | F04D 13/027 |
| 2020/0049245 | A1* | 2/2020 | Yin | B60K 6/387 |
| 2022/0065090 | A1* | 3/2022 | Ejim | E21B 47/008 |

* cited by examiner

*Primary Examiner* — Kenneth J Hansen

(74) *Attorney, Agent, or Firm* — Vorys, Sater, Seymour and Pease, LLP

(57) ABSTRACT

An electrical submersible pump system for preventing high-pressure drawdown while starting includes a fixed-speed drive, hermetically-sealed motor including a motor shaft extending therefrom, a discharge pump including a pump shaft extending therefrom, and a torque converter interposing the motor and the pump. The torque converter includes a hollow body filled with a conversion fluid, a motor-side rotor mated to an end of the motor shaft and operable generate a vortex of the conversion fluid within the hollow body when the motor shaft is provided with a torque, and a pump-side rotor mated to an end of the pump shaft and rotatable as the vortex impinges on the pump-side rotor, and thereby providing a torque to the pump shaft to operate the discharge pump.

17 Claims, 5 Drawing Sheets

SMOOTH-STARTING ELECTRICAL SUBMERSIBLE PUMPS

FIELD OF THE DISCLOSURE

The present disclosure relates generally to artificial lift devices and, more particularly, to eliminating high-pressure drawdown in electrical submersible pumps.

BACKGROUND OF THE DISCLOSURE

Hydrocarbon extraction operations within producing wells commonly employ methods of generating artificial lift to increase a flowrate of hydrocarbons out of the corresponding wellbore and/or to produce from depleted wells that are unable to flow naturally without an artificial lift method. In the oil and gas industry it is estimated that most wells may require artificial lift during their lifetime, and an estimated half of all active wells currently utilize at least one method of generating artificial lift. These methods of artificial lift lower the bottomhole pressure of the wellbore, thus facilitating an increased rate of flow out of the wellbore. One common method for generating artificial lift is the deployment of an electrical submersible pump or "ESP". The electrical submersible pump employs a motor and a discharge pump to pump formation fluid uphole, thus reducing the bottomhole pressure and initiating further flow of formation fluid into the wellbore.

Electrical submersible pumps are commonly powered via a fixed-speed drive or a variable-speed drive as the motor for generating artificial lift. The choice between a fixed-speed and a variable-speed drive often depends on the properties of the wellbore and formation, and each drive type includes advantages and drawbacks. Fixed-speed drives work on a constant frequency for consistent generation of artificial lift, and are commonly utilized in wells with steady production. However, fixed-speed drives commonly generate severe high-pressure drawdowns during pump initiation, as artificial lift is rapidly generated and the bottomhole pressure drops suddenly. During these high-pressure drawdowns, the high pressure within the formation may create a rapid flow of formation fluids into the wellbore that may threaten and damage downhole completion equipment. In completions including sand screens for filtering out sand particles from the formation fluid, the high-pressure drawdown may puncture, damage, or entirely destroy the sand screens.

As an alternative, variable-speed drives work on a variable frequency to change the speed of pumping. Variable-speed drives utilize a frequency varying from about one hertz to about 70 hertz, thus allowing for smooth starting of the electrical submersible pump. Variable-speed drives may be commonly chosen for wells that exhibit fluctuating production, such that the pumping rate of the electrical submersible pump may match the production fluctuations. However, as variable-speed drives ramp up in speed from the about one hertz to the about 70 hertz, for example, the initially provided frequency is often incompatible with the discharge pump of the electrical submersible pump. As the frequency is provided outside of the operational pump curve, the use of a variable-speed drive for smooth-starting may have negative mechanical impacts on the discharge pump which may result in erosion and damage to the electrical submersible pump.

Accordingly, systems and methods for smooth-starting an electrical submersible pump system regardless of the speed drive are desirable.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, an electrical submersible pump system for preventing high-pressure drawdown while starting includes a fixed-speed drive, hermetically-sealed motor including a motor shaft extending therefrom, a discharge pump including a pump shaft extending therefrom, and a torque converter interposing the motor and the pump. The torque converter includes a hollow body filled with a conversion fluid, a motor-side rotor mated to an end of the motor shaft and operable generate a vortex of the conversion fluid within the hollow body when the motor shaft is provided with a torque, and a pump-side rotor mated to an end of the pump shaft and rotatable as the vortex impinges on the pump-side rotor, and thereby providing a torque to the pump shaft to operate the discharge pump.

In another embodiment, a method of starting an electrical submersible pump system disposed in a wellbore includes activating a hermetically-sealed motor including a motor shaft extending therefrom and thereby rotating the motor shaft, providing a torque to a motor-side rotor via the motor shaft, the motor-side rotor being arranged within a torque converter, and generating a vortex of a conversion fluid housed within the torque converter as the motor-side rotor rotates. The method further includes impinging the vortex on a pump-side rotor arranged within the torque converter and thereby rotating the pump-side rotor to transfer a portion of the torque from the motor-side rotor to the pump-side rotor, transferring a portion of the torque from the motor-side rotor to a pump-side rotor included in an upper end of the torque converter through the rotation of the conversion fluid, and actuating, via a pump shaft operatively coupled to the pump-side rotor, a discharge pump as the pump-side rotor rotates, and thereby pumping a formation fluid through the electrical submersible pump system.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
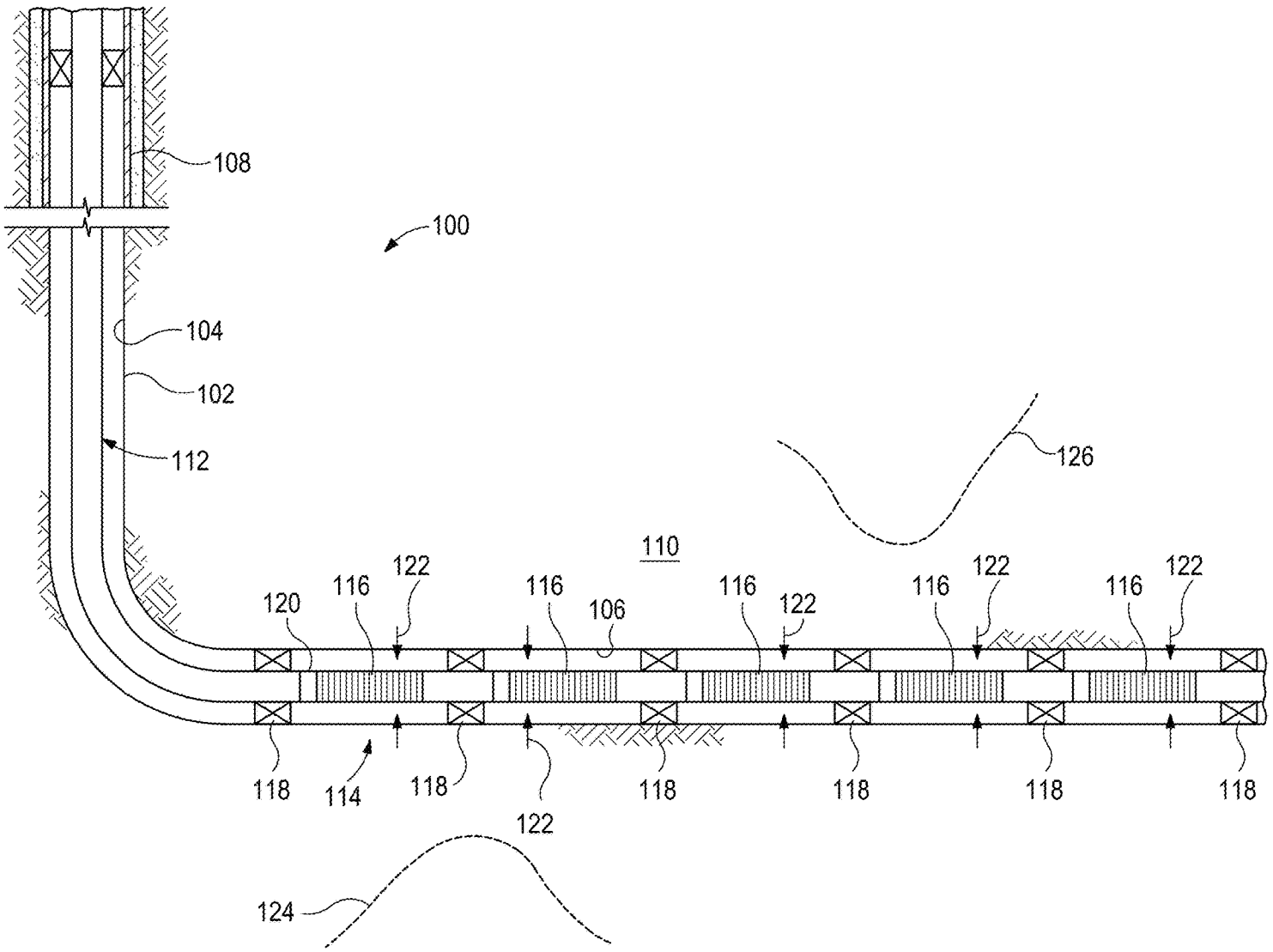
FIG. 1 is a schematic diagram of an example well system that may employ one or more of the principles of the present disclosure, according to one or more embodiments.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to artificial lift devices and, more particularly, to eliminating high-pressure drawdown in electrical submersible pumps. The systems and methods disclosed herein may include the use of a torque converter interposing the motor and the discharge pump of an electrical submersible pump, such that a smooth-starting operation may be performed using a fixed-speed drive motor or a variable-speed drive motor. The torque converter may include a plurality of rotors mounted to the motor and the discharge pump, and the torque converter may be filled with a conversion fluid, such as oil (or another hydraulic fluid), that enables the conversion of torque into hydraulic rotation. In the disclosed embodiments, the motor may provide torque to the torque converter, which generates a vortex in the conversion fluid within the torque converter, and thereby rotates a rotor mounted to a shaft of the discharge pump. In these embodiments, as the conversion fluid continues to circulate in the vortex in the torque converter, the rotor and shaft connected to the discharge pump may steadily increase until reaching full operational speeds. Through the use of a torque converter, the disclosed embodiments may enable a fixed-speed or variable-speed drive motor in a smooth-starting system that may ramp up pumping speeds of the discharge pump, thus eliminating high-pressure drawdown while also maintaining health of the electrical submersible pump.

FIG. 1 is a schematic diagram of an example well system 100 that may employ one or more of the principles of the present disclosure, according to one or more embodiments. As depicted, the well system 100 includes a wellbore 102 that extends through various earth strata and has a substantially vertical section 104 that transitions into a substantially horizontal section 106. A portion of the vertical section 104 may have a string of casing 108 cemented therein, and the horizontal section 106 may extend through a hydrocarbon bearing subterranean formation 110. In some embodiments, the horizontal section 106 may be uncompleted and otherwise characterized as an "open hole" section of the wellbore 102. In other embodiments, however, the casing 108 may extend into the horizontal section 106, without departing from the scope of the disclosure.

A string of production tubing 112 may be positioned within the wellbore 102 and extend from a surface location (not shown), such as the Earth's surface. The production tubing 112 provides a conduit for fluids extracted from the formation 110 to travel to the surface location for production. A completion string 114 may be coupled to or otherwise form part of the lower end of the production tubing 112 and arranged within the horizontal section 106. The completion string 114 divides the wellbore 102 into various production intervals adjacent to the subterranean formation 110. To accomplish this, as depicted, the completion string 114 may include a plurality of sand control screen assemblies 116 axially offset from each other along portions of the production tubing 112. Each screen assembly 116 may be positioned between a pair of wellbore packers 118 that provides a fluid seal between the completion string 114 and the inner wall of the wellbore 102, and thereby defining discrete production intervals.

In operation, each sand control screen assembly 116 serves the primary function of filtering particulate matter out of the production fluid stream originating from the formation 110 such that particulates and other fines are not produced to the surface. The completion string 114 may further include an electrical submersible pump (ESP) 120 operable to help draw in and otherwise regulate the flow of fluids 122 into the completion string 114 and, therefore, into the production tubing 112. More specifically, the ESP 120 may be used as an artificial lift device operable to draw in the fluids 122 from the surrounding formation 110 and "lift" the fluids 122 toward the well surface.

Conventional ESPs include a motor, a seal, and a pump arranged in series. The motor receives electrical power at a certain frequency from the surface location and creates a torque, which is transferred rotationally to the seal. The seal generally comprises a shaft that connects the motor and the pump. The pump receives the transferred torque, which causes rotation of one or more pump impellers, and rotating the impellers causes the fluids 122 to be drawn into the completion string 114 and "lifted" to the surface location.

As discussed above, ESPs are commonly powered by either a fixed speed drive (FSD) or a variable speed drive (VSD). The FSD ESP works on a constant frequency transmitted to the ESP, while the VSD ESP works on an adjustable frequency transmitted to the ESP. The selection between FSD and VSD often depends on petroleum engineering design. For example, in wells that exhibit constant and steady production, FSD ESPs are usually deployed. The FSD ESP is powered at a specific frequency that cannot be changed from surface, and is based on the frequency rating of the available electrical grid power. If a change of frequency in FSD ESPs is desired, the power provider must change the supplied frequency. In contrast, wells that exhibit fluctuating production are usually equipped with VSD ESPs in which the frequency of the power provider can be altered in response to well conditions.

One disadvantage of utilizing FSD ESPs is the severe drawdown imposed on hydrocarbon-bearing formations, which can result in damage to the completion string 114. For instance, extreme drawdown could collapse portions of the sand screens 116, and/or form a pinhole across one or more of the sand screens 116, thereby resulting in well integrity failure. Another disadvantage of utilizing FSD ESPs is that water coning 124 or gas coning 126 in the subterranean formation 110 can result. In this phenomenon, the drawdown created by the FSD ESP enables formation-associated water to migrate and build around the wellbore 102 in accordance with the water's relative permeability.

Regarding VSD ESPs, the frequency can be from 1 Hz to 70 Hz, which allows for smooth starting. However, this is not always the case since conventional ESPs cannot be started at 1 Hz because it will be out of its pump curve, which could have a negative mechanical impact resulting in mechanical erosion of the ESP.

According to embodiments of the present disclosure, a torque converter (not labeled) may be included in the ESP 120 and installed between the motor and the seal. As described herein, the torque converter may be operable to transmit rotational force exerted by the shaft inside the seal and in gradual increments. Accordingly, embodiments described herein include methods of adjusting the ESP 120 startup to a smooth transition to the total desired rate and regardless of the speed drive. The torque converter provides a solution for sudden high-pressure drawdown once starting the ESP 120 in sandstone formations, for example. By mitigating the sudden drawdown, component parts of the completion string 114 may avoid damage by smooth starting the ESP 120. The transmitted rotational forces will not be reflected at a 1:1 ratio, but will instead build up gradually until reaching the 1:1 ratio. In sandstone formations, incorporation of the torque converter helps to preserve the structural and operational integrity of the sand screens 116 by avoiding (mitigating) the sudden drawdown that introduces a sudden influx of formation fluids 122 into the completion string 114.

It should be noted that even though FIG. 1 depicts the sand control screen assemblies 116 and the ESP 120 as being arranged in an open hole portion of the wellbore 102, embodiments are contemplated herein where the sand control screen assemblies 116 and/or the ESP 120 are arranged within cased portions of the wellbore 102. Also, even though FIG. 1 depicts a single sand control screen assembly 116 arranged in each production interval, any number of sand control screen assemblies 116 may be deployed within a particular production interval without departing from the scope of the disclosure. In addition, even though FIG. 1 depicts multiple production intervals separated by the packers 118, any number of production intervals with a corresponding number of packers 118 may be used. In other embodiments, the packers 118 may be entirely omitted from the completion interval, without departing from the scope of the disclosure.

Furthermore, while FIG. 1 depicts the sand control screen assemblies 116 and the ESP 120 as being arranged in the horizontal section 106 of the wellbore 102, the sand control screen assemblies 116 and the ESP 120 are equally well suited for use in the vertical section 104 or portions of the wellbore 102 that are deviated, slanted, multilateral, or any combination thereof. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
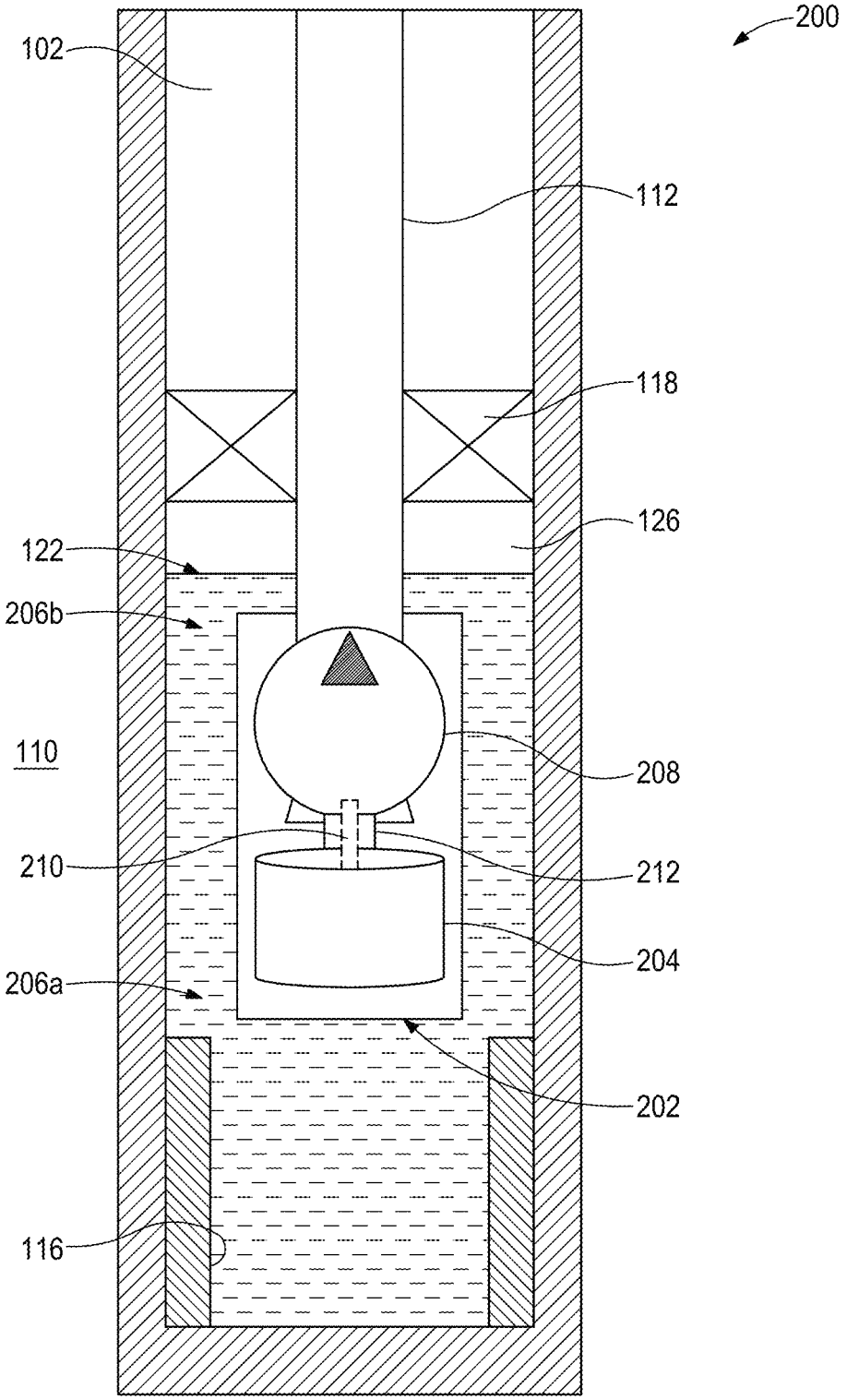
FIG. 2 is a schematic view of a traditional electrical submersible pump system disposed within a wellbore of a producing well exhibiting constant production.

FIG. 2 is a schematic view of a traditional electrical submersible pump system 200 disposed within the wellbore 102 of a producing well exhibiting constant production. The electrical submersible pump system 200 may be used in conjunction with the system 100. The electrical submersible pump system 200 may be run downhole past one or more packers 118 operable to prevent flow of fluids through the wellbore 102 and into an annulus thereof (not shown). The electrical submersible pump system 200 may include an electrical submersible pump (ESP) 202, which may be the same as or similar to the ESP 120 of FIG. 1. As illustrated, the ESP 202 may be arranged within the wellbore 102 and may be immersed in formation fluid 122 produced by the producing well after being drawn into the wellbore 102 through the sand screens 116. As discussed above, the sand screens 116 may interpose the wellbore 102 and the surrounding formation 110, thus enabling the flow of formation fluids 122 therethrough while preventing the flow of sand particles entering into the wellbore 102.

As illustrated, the electrical submersible pump 202 may be run downhole as attached to or otherwise forming part of the production tubing 112. The production tubing 112 may comprise, for example, coiled tubing, and may be used to transport formation fluids 122 uphole and to the surface location. The production tubing 112 may also include a means for powering the ESP 202 (e.g., an electrical line or wire). Electrical power provided to the ESP 202 may be used to power a fixed-speed or variable-drive, hermetically-sealed motor 204 of the ESP 202 disposed at a bottom end 206*a* of the ESP 202. The motor 204 may provide a constant or variable torque to a discharge pump 208 disposed at or near a top end 206*b* of the ESP 202 via a motor shaft 210 extending from the motor 204. The motor 204 may be separated from the pump 208 via a seal 212 interposing the motor 204 and the pump 208. The seal 212 may prevent the flow of any fluids across the seal 212 and into the motor 204 from the pump 208, and may further aid in the hermetic sealing of the motor 204.

During traditional operation of the electrical submersible pump system 200, the motor 204 may be supplied power via a wire or line running along the production tubing 112. The motor 204 may comprise a fixed speed drive (FSD) or a variable speed drive (VSD). In applications where the motor 204 comprises an FSD, a constant torque may be supplied through the motor shaft 210 and into the pump 208. The constant torque may rapidly initiate pumping operations of the pump 208 at full power, such that a fluid gap 214 is created below the packer 206. During this rapid initiation of pumping operations, the presence of any foreign objects within the pump 208 may deteriorate the internal components thereof. The deterioration of internal components of the pump 208, such as an internal shaft or impeller, may reduce efficiency and shorten the lifespan of the pump 208. Further, the fluid gap 214 may be representative of a high-pressure drawdown, as a high flowrate of formation fluid 122 out of the wellbore 102 is initiated and pressure below the packer 206 drops rapidly Accordingly, a flow of formation fluid 122 into the wellbore 102 through the sand screens 116 may occur with a velocity or pressure greater than a rating of the sand screens 116 or any other completions. As such, the initiation of flow via a fixed-speed drive motor 204 may lead to damage or destruction of the sand screens 116, enabling sand to flow into the wellbore 102 and leading to costly repairs and downtime.

Figure 3:
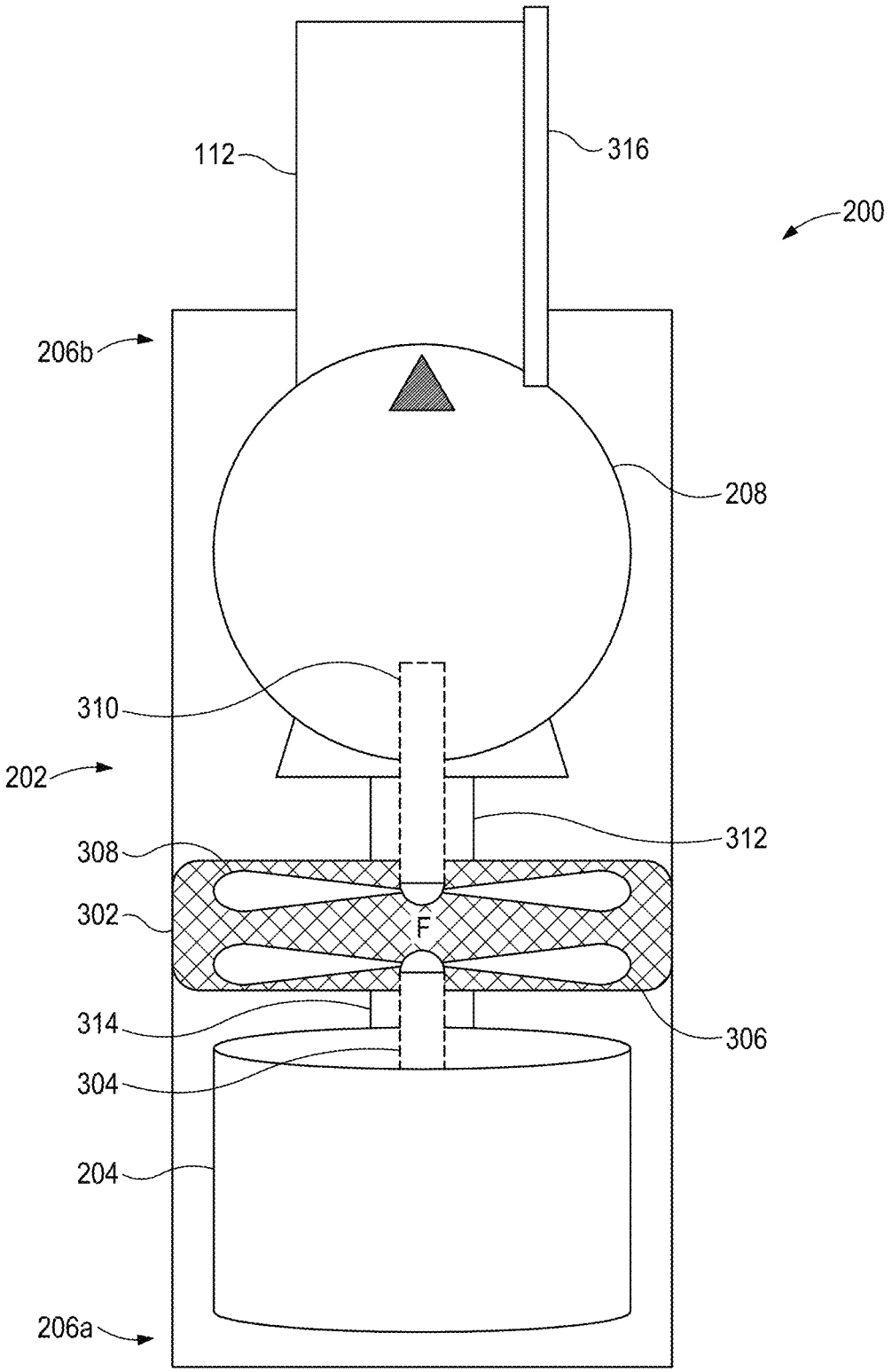
FIG. 3 is a schematic view of a modified electrical submersible pump that may be deployed in the electrical submersible pump system to enable the smooth-starting of pumping operations.

FIG. 3 is a schematic view of a modified ESP 202 that may be deployed in the ESP system 200 to enable smooth-starting of pumping operations. In some embodiments, the modified ESP 202 may include a fixed-speed, hermetically-sealed motor 204 disposed at a bottom end 206*a* of the modified ESP 202, as well as a discharge pump 208 disposed at a top end 206*b* of the modified ESP 202, similar to the ESP 202 of FIG. 2. In other embodiments, however, the motor 204 may comprise a variable speed drive, without departing from the scope of the disclosure.

According to embodiments of the present disclosure, however, the modified ESP 202 may further include a torque converter 302 axially interposing the motor 204 and the pump 208. A motor shaft 304 may extend from the motor 204 and into the torque converter 302, and within the torque converter 302, the motor shaft 304 may be mated or otherwise rotationally coupled to a motor-side rotor 306 of the torque converter 302. The torque converter 302 may further include a pump-side rotor 308 on an opposing side of the torque converter 302 from the motor-side rotor 306. The pump-side rotor 308 may be mated to a pump shaft 310 extending from the pump 208 and operable to provide rotation to the pump 208. The torque converter 302 may be filled with a conversion fluid "F", which may be a low viscosity fluid that may be selected from a group consisting of petroleum, mineral oil, synthetic oils, and any combination thereof.

The modified ESP 202 may further include a primary seal 312 interposing the pump 208 and the torque converter 302. The primary seal 312 may provide a housing (or enclosure) for the pump shaft 310, and may prevent the flow of conversion fluid "F" into the pump 208 while preventing the flow of formation fluid 122 of FIG. 2 from the pump 208 into the torque converter 302. The modified ESP 202 may further include a secondary seal 314 interposing the motor 204 and the torque converter 302. The secondary seal 314 may similarly prevent the flow of conversion fluid "F" into the motor 204, while further providing a housing (enclosure) for the motor shaft 304.

In example operation of the modified ESP 202, the motor 204 may be powered via a control line 316 (e.g., wire, cable, etc.) extending along the production tubing 112 and terminating at the modified ESP 202. In embodiments where the motor 204 is a fixed-speed drive, a constant torque may be provided to the motor shaft 304 extending therefrom, such that the motor shaft 304 may begin rotating at a desired speed. As the motor shaft 304 rotates, the rotationally-coupled motor-side rotor 306 may begin to rotate at a similar speed. Rotation of the motor-side rotor 306 may initiate hydraulic rotation within the conversion fluid "F", such that the conversion fluid "F" within the torque converter 302 forms a hydraulic vortex that incrementally ramps up in rotational speed. The hydraulic vortex within the conversion fluid "F" may impart rotation into the pump-side rotor 308, initially at a low speed and eventually ramping up to full operational speeds for the pump 208.

The pump shaft 310 rotationally-coupled to the pump-side rotor 308 may accordingly begin rotating, as the torque from the motor 204 is imparted into the pump shaft 310 via the vortex of the torque converter 302. The pump 208 may be in fluid communication with the production tubing 112, and may thus begin pumping the formation fluid 122 (FIGS. 1 & 2) into the production tubing 112 at a low pumping rate as the vortex of the conversion fluid "F" spins up to operational speeds, and eventually transmits all torque from the motor 204 into the pump 208 for standard operation. The ramping-up process provided by the torque converter 302, however, may reduce or eliminate the high-pressure drawdown of the ESP system 200. Further, the ramping-up process may be initiated at a sufficient rate to limit the time the pump 208 spends outside of the operational pump curve, thus limiting mechanical damage or erosion of the modified ESP 202. As such, the torque converter 302 may enable smooth-starting of the modified ESP 202 without creating high-pressure drawdown and while limiting damage to the components thereof. The modified ESP 202 may thus be utilized in systems such as the electrical submersible pump system 200 of FIG. 2 that may include sensitive downhole completions, such as the sand screens 116 (FIGS. 1 and 2).

Figure 4A:
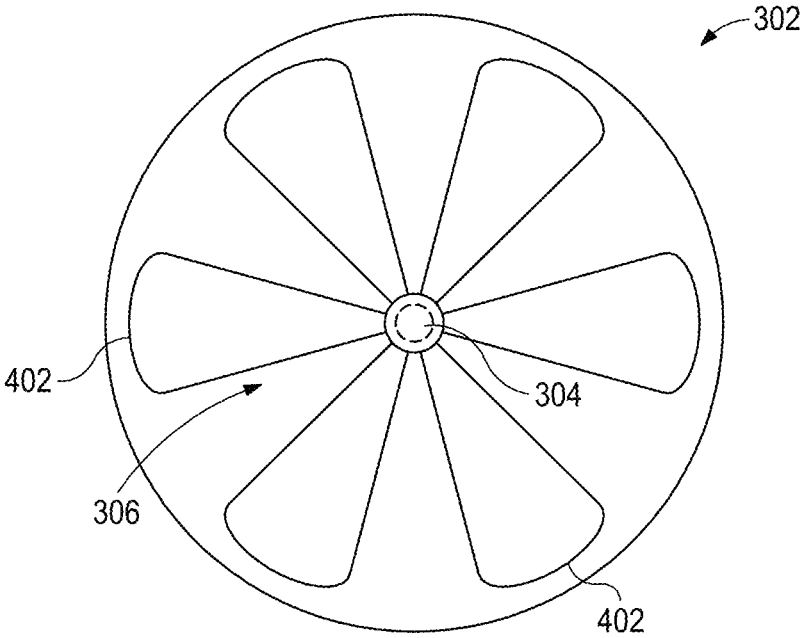
FIG. 4A is a schematic top view of an inside of the torque converter and the motor-side rotor, according to at least one embodiment of the present disclosure.

FIG. 4A is a schematic top view of the inside of the torque converter 302 and the motor-side rotor 306, according to at least one embodiment of the present disclosure. The motor-side rotor 306 may be centrally-located within the torque converter 302, and the motor shaft 304 may protrude centrally into the motor-side rotor 306. In the illustrated embodiment, the motor-side rotor 306 includes six rotor blades 402 symmetrically distributed about the motor-side rotor 306. However, it should be noted that any number of rotor blades 402, and any design thereof, may be utilized for the motor-side rotor 306, without departing from the scope of the present disclosure. The rotor blades 402 may exhibit an angle relative to the torque converter 302, such that the conversion fluid "F" (FIG. 3) may be efficiently rotated (i.e., circulated until generating a vortex) via the motor-side rotor 306. Similarly, the pump-side rotor 308 (FIG. 3) may exhibit the same angle, shape, and number of rotor blades 402, such that a 1:1 ratio may be achieved in the torque converter 302 at full speed.

Figure 4B:
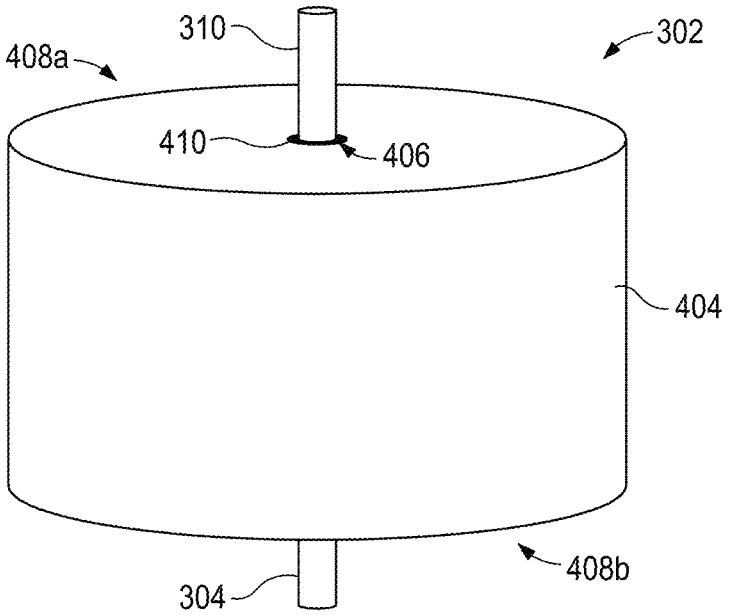
FIG. 4B is a schematic side view of the torque converter with the motor shaft and pump shaft extending therefrom, according to at least one embodiment of the present disclosure.

FIG. 4B is a schematic side view of the torque converter 302 with the motor shaft 304 and pump shaft 310 extending therefrom in opposite directions, according to at least one embodiment of the present disclosure. As illustrated, the torque converter 302 may include a cylindrical body 404 having opposing upper and lower ends 408*a*, 408*b* and exhibiting a circular cross-section. The body 404 may be sized and otherwise configured to house and retain the motor-side rotor 306, the pump-side rotor 308, and the conversion fluid "F" of FIG. 3 therein. The hollow body 404 may include a plurality of shaft apertures 406 on the upper end 408*a* and the lower end 408*b* of the torque converter 302. The shaft apertures 406 may provide a space through which the motor shaft 304 and the pump shaft 310 may extend towards the corresponding motor 204 and pump 208 of FIG. 3, respectively. In some embodiments, the torque converter 302 may include intermediate seals 410 within the shaft apertures 406 to aid the primary seal 312 and the secondary seal 314 of FIG. 3 in preventing fluid flow out of the torque converter 302.

Figure 5:
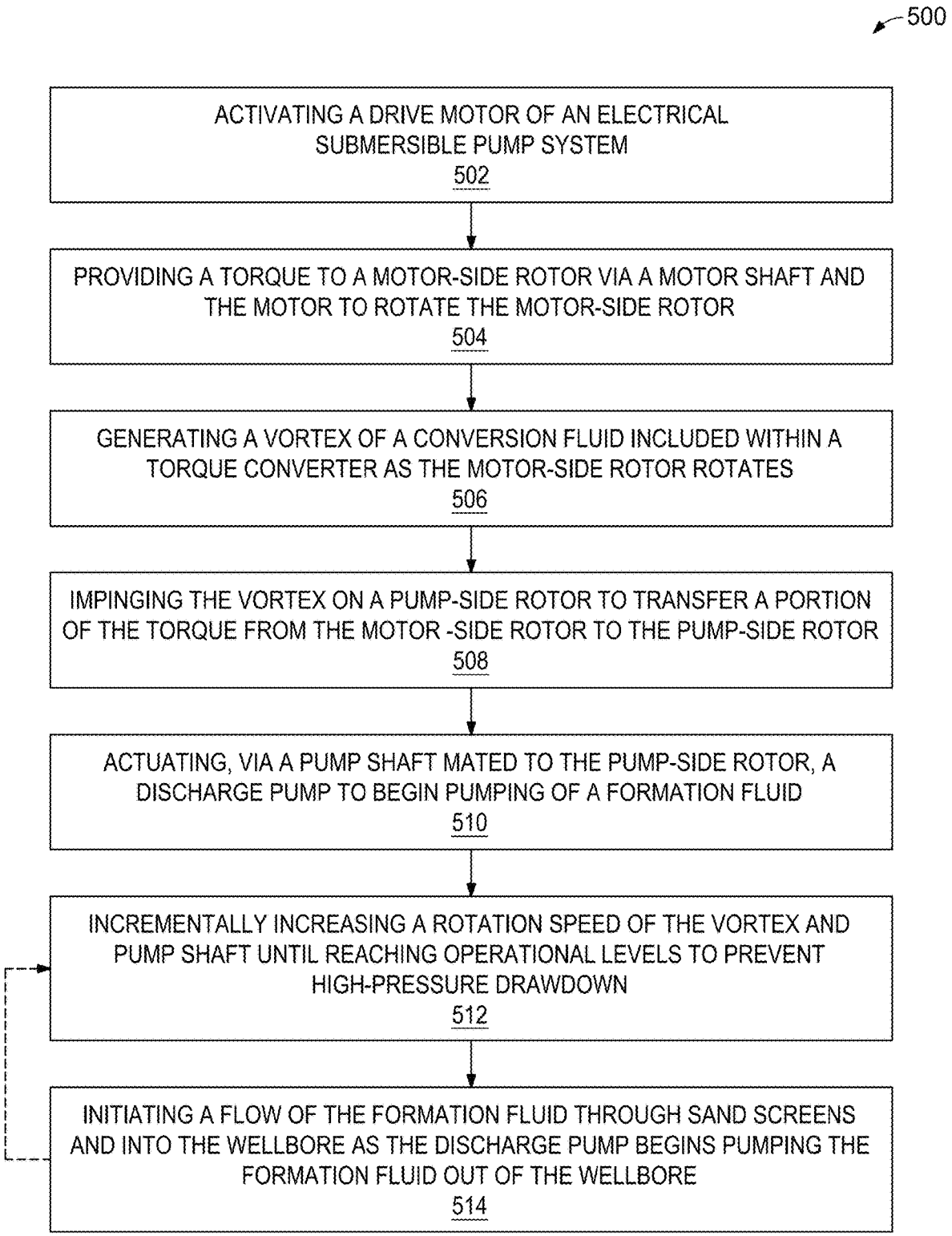
FIG. 5 is an example method for smooth-starting an electrical submersible pump system disposed in a wellbore, according to one or more embodiments consistent with the present disclosure.

In view of the structural and functional features described above, example methods will be better appreciated with reference to FIG. 5. While, for purposes of simplicity of explanation, the example methods of FIG. 5 are shown and described as executing serially, it is to be understood and appreciated that the present examples are not limited by the illustrated order, as some actions could in other examples occur in different orders, multiple times and/or concurrently from that shown and described herein. Moreover, it is not necessary that all described actions be performed to implement the methods, and conversely, some actions may be performed that are omitted from the description.

FIG. 5 depicts a schematic flowchart of an example method 500 for smooth-starting an electrical submersible pump system disposed in a wellbore, according to one or more embodiments consistent with the present disclosure. The method 500 may be implemented by the system 200 with the modified ESP 202, as shown in FIGS. 3 and 4A-4B. Thus, reference may be made to the example of FIGS. 3 and 4A-4B in the example of FIG. 5. The method 500 may begin at 502 with activating a hermetically-sealed motor (e.g., the motor 204) disposed at a bottom end (e.g., the bottom end 206*a*) of the electrical submersible pump system (e.g., the electrical submersible pump system 200). The motor may include a motor shaft (e.g., the motor shaft 304) extending therefrom such that activating the motor may initiate rotation of the motor shaft. In some embodiments, the motor at 402 may be powered via one or more electrical transmission lines (e.g., the control line 316) extending along tubing (e.g., the production tubing 112) extended into the wellbore (e.g., the wellbore 102), and may actuate in response to signal transmitted via the transmission lines.

The method 500 may continue at 504 with providing a torque to a motor-side rotor (e.g., the motor-side rotor 306) via the motor shaft and the motor. In some embodiments, the motor-side rotor may be disposed within a lower end (e.g., the lower end 408*b*) of a torque converter (e.g., the torque converter 302). Thus, providing the torque to the motor-side rotor may accordingly rotate the motor-side rotor within the inside of the torque converter. As the motor-side rotor begins to rotate, the method 500 may continue at 506 with generating a vortex of a conversion fluid (e.g., the conversion fluid "F") included within the torque converter as the motor-side rotor rotates. In some embodiments, the torque converter 302 may be substantially filled with the conversion fluid, and the rotation of the motor-side rotor may generate the vortex of conversion fluid as the rotation is imparted into the conversion fluid.

The method 500 may continue at 508 with impinging the vortex on a pump-side rotor (e.g., the pump-side rotor 308) included in an upper end (e.g., the upper end 408*a*) of the torque converter to transfer a portion of the torque from the motor-side rotor to the pump-side rotor. As the conversion fluid vortex circulates within the torque converter, driven by the motor-side rotor, the conversion fluid vortex may exhibit a force on the pump-side rotor to begin rotation thereof. As such, the conversion fluid and the torque converter may convert a torque into rotational hydraulic motion, which may then be converted back into a torque via the pump-side rotor. Accordingly, the method 500 may continue at 510 with actuating, via a pump shaft (e.g., the pump shaft 310) mated to the pump-side rotor, a discharge pump (e.g., the pump 208) disposed at a top end (e.g., the top end 206*b*) of the electrical submersible pump system to begin pumping of a formation fluid (e.g., the formation fluid 122). As the pump-side rotor converts the rotational hydraulic motion of the vortex back into a torque, the torque may be accordingly applied transferred to the discharge pump via the pump shaft mated, or rotationally-coupled, to the pump-side rotor. In some embodiments, during the operation of the torque converter, a primary seal (e.g., the primary seal 312) may prevent fluid flow between the torque converter and the discharge pump as the pump shaft rotates within the primary seal. Similarly, a secondary seal (e.g., the secondary seal 314) may prevent fluid flow between the torque converter and the motor as the motor shaft rotates within the secondary seal.

The method 500 may continue at 512 with incrementally increasing a rotation speed of the vortex and, consequently, the pump shaft until reaching operational levels to prevent high-pressure drawdown. As the fixed-speed drive motor continues to spin the motor-side rotor, the conversion fluid may continue to accelerate within the torque converter. In some embodiments, the acceleration of the conversion fluid vortex may continue to steadily increase until reaching the fixed-speed of the motor, and thus reaching a maximum operational level for providing a torque to the pump. The inertia of the conversion fluid vortex may enable the slow, smooth starting of the pump, as the torque converter slowly builds speed therein. As such, the slow, smooth starting of the pump may reduce or eliminate any drawdown within the wellbore, as the pressures therein may slowly balance over time.

Accordingly, the method 500 may continue at 514 with initiating a flow of the formation fluid through the sand screens (e.g., the sand screens 116) and into the wellbore as the discharge pump begins pumping the formation fluid out of the wellbore. As discussed above, the flow of formation fluid out of the wellbore may reduce the pressure below a packer (e.g., the packer 206), while a high pressure remains within the formation behind the sand screens. As such, as the slow, smooth starting of the electrical submersible pump occurs, the pressure below the packer may slightly decrease, enabling flow from the formation into the wellbore at a slow initial rate. The method 500 may then continue at 412 with further incremental increasing of the pumping speed, which in turn initiates further, faster flow of formation fluid into the wellbore from the formation. The method 500 may cyclically continue until reaching an operational speed of the pumping, at which point the pressure balance may be maintained via a steady stream of formation fluid into the wellbore and out through the tubing, without drawdown or damage to any downhole completions.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. An electrical submersible pump system for preventing high-pressure drawdown while starting, the electrical submersible pump system comprising:

a fixed-speed drive, hermetically-sealed motor including a motor shaft extending therefrom;

a discharge pump including a pump shaft extending therefrom; and a torque converter interposing the motor and the pump and including:

a hollow body filled with a conversion fluid;

a motor-side rotor mated to an end of the motor shaft and operable to generate a vortex of the conversion fluid within the hollow body when the motor shaft is provided with a torque;

a pump-side rotor mated to an end of the pump shaft and rotatable as the vortex impinges on the pump-side rotor, and thereby providing a torque to the pump shaft to operate the discharge pump;

a plurality of shaft apertures defined in the hollow body and sized to receive the motor shaft and the pump shaft;

a primary seal interposing the torque converter and the discharge pump, the primary seal being operable to prevent fluid flow between the torque converter and the discharge pump; and a secondary seal interposing the torque converter and the motor, the secondary seal being operable to prevent fluid flow between the torque converter and the motor, wherein the primary seal provides a housing for the pump shaft and extends from the pump to the torque converter.

2. The electrical submersible pump system of claim 1, wherein the electrical submersible pump system is disposed in a wellbore of a production well.

3. The electrical submersible pump system of claim 2, further comprising a completion string including a plurality of sand screens installed at a bottom of the wellbore and operable to prevent sand particles from entering the wellbore.

4. The electrical submersible pump system of claim 2, further comprising a packer installed uphole from the discharge pump to prevent formation fluid from entering an annulus of the wellbore uphole from the packer.

5. The electrical submersible pump system of claim 4, further comprising production tubing in fluid communication with the discharge pump for transporting the formation fluid out of the wellbore, wherein the tubing extends through the packer.

6. The electrical submersible pump system of claim 1, wherein the torque converter incrementally increases a rotation speed of the pump shaft until reaching operational levels.

7. The electrical submersible pump system of claim 1, wherein the conversion fluid comprises an oil selected from the group consisting of petroleum, mineral oil, synthetic oils, and any combination thereof.

8. The electrical submersible pump system of claim 1, wherein the secondary seal provides a housing for the motor shaft and extends from the motor to the torque converter.

9. The electrical submersible pump system of claim 1, wherein the pump shaft is a single, uninterrupted shaft extending from the pump and into the torque converter.

10. The electrical submersible pump system of claim 1, wherein the hermetically-sealed motor is isolated from the conversion fluid of the torque converter.

11. A method of starting an electrical submersible pump system disposed in a wellbore, the method comprising:

activating a hermetically-sealed motor including a motor shaft extending therefrom and thereby rotating the motor shaft;

providing a torque to a motor-side rotor via the motor shaft, the motor-side rotor being arranged within a body of a torque converter defining a plurality of shaft apertures sized to receive the motor shaft and a pump shaft;

preventing fluid flow across the shaft apertures via a primary seal interposing the torque converter and the discharge pump and a secondary seal interposing the torque converter and the motor, the secondary seal providing a housing for the motor shaft and extending from the motor to the torque converter;

generating a vortex of a conversion fluid housed within the torque converter as the motor-side rotor rotates;

impinging the vortex on a pump-side rotor arranged within the torque converter and thereby rotating the pump-side rotor to transfer a portion of the torque from the motor-side rotor to the pump-side rotor;

transferring a portion of the torque from the motor-side rotor to a pump-side rotor included in an upper end of the torque converter through the rotation of the conversion fluid; and actuating, via the pump shaft operatively coupled to the pump-side rotor, a discharge pump as the pump-side rotor rotates, and thereby pumping a formation fluid through the electrical submersible pump system.

12. The method of claim 11, wherein actuating the motor is performed in response to a signal transmitted via a control line extending along production tubing within the wellbore and terminating at the motor.

13. The method of claim 11, further comprising incrementally increasing a rotation speed of the vortex within the torque converter and thereby increasing a rotation speed of the pump shaft until reaching operational levels to prevent high-pressure drawdown.

14. The method of claim 13, wherein incrementally increasing the rotation speed of the pump shaft limits or prevents damage to one or more sand screens in fluid communication with the electrical submersible pump system.

15. The method of claim 14, further comprising initiating a flow of the formation fluid through the one or more sand screens and into the wellbore as the discharge pump begins pumping the formation fluid out of the wellbore.

16. The method of claim 11, further comprising mating the pump-side rotor directly to an end the pump shaft, wherein the pump shaft is a single, uninterrupted shaft extending from the pump and into the torque converter.

17. The method of claim 11, wherein preventing fluid flow across the shaft apertures via one or more intermediate seals installed within each shaft aperture further includes maintaining fluid isolation of the conversion fluid from the electrical submersible pump system via the intermediate seals and the body of the torque converter.

* * * * *